United States Patent [19]

Nylander et al.

[11] Patent Number: 4,531,334

[45] Date of Patent: Jul. 30, 1985

[54] EARTHQUAKE-PROOF CONSTRUCTION BRACKET

[76] Inventors: Eric F. Nylander, 179 Arbor St., San Francisco, Calif. 94131; Thomas E. Fourre, 729 Edinburgh St., San Francisco, Calif. 94112

[21] Appl. No.: 508,136

[22] Filed: Jun. 27, 1983

[51] Int. Cl.[3] ..... E04H 12/18

[52] U.S. Cl. ..... 52/109; 52/573; 52/702; 248/228

[58] Field of Search ..... 52/109, 289, 573, 702, 52/167; 248/277, 228

[56] References Cited

U.S. PATENT DOCUMENTS 3,537,221 11/1970 Helfman et al. ..... 52/289

FOREIGN PATENT DOCUMENTS 529429 7/1931 Fed. Rep. of Germany ..... 52/167

*Primary Examiner*—Carl D. Friedman
*Assistant Examiner*—Naoko Nakazawa Slack
*Attorney, Agent, or Firm*—Limbach, Limbach & Sutton

[57] ABSTRACT

The apparatus comprises means for pivotally attaching one end of a link means to the structure, means for pivotally attaching the other end of the link means to the beam at a point distal from the structure, and means for supplying a compressing force to the beam intermediate the ends of the link means, the compressing force responsive to relative motion between the beam and the structure.

6 Claims, 4 Drawing Figures

EARTHQUAKE-PROOF CONSTRUCTION BRACKET

DESCRIPTION

1. Technical Field

This invention relates to an apparatus for joining beams to structures and more particularly to an apparatus which joins cross-beams to beams, standing walls and the like and which will resist the separation of these beams during adverse environmental conditions.

2. Background Art

A common problem in the construction industry has been the joining of beams or support members in a perpendicular configuration. A cross-beam is joined to either another beam or to a standing wall and a structural connection made so that loads can be transferred from one beam to the other. Typically the cross-beam is required to bear loads orthogonal to its longitudinal dimension and to resist compression so as to maintain proper orientation of beams or walls connected to either end.

Such connections are typically made with a web connection which consists of two angle brackets attached to opposite sides of the beam. These are in turn connected to the face of the supporting beam or standing wall at right angles.

Another method of connecting such beams is called a seat connection. It consists of a bracket or shelf on which the end of the beam rests. This connection is intended to furnish the end reaction of the supported beam.

A common problem with the prior art structural connections when applied to construction in wood is that they anticipate that force will be applied equally to both ends of the cross beam. However, under certain environmental conditions a force can be applied to both ends of the cross beam in directions which tend to simultaneously separate it from both supporting beam or standing wall.

Such a situation occurs during an earthquake, where the force wave traveling through the structure tends to separate the standing walls or support beams. This causes the walls to fall outwardly away from one another and separate from the cross beams at either end. In this situation, resistance to these forces is concentrated on the strength of materials and the size of the attaching bolts used to connect the structural connections to the beams.

Wooden beams are constructed so that the grain of the wood is in parallel with the longitudinal axis of the beam. In the event that forces are applied longitudinally on the beam, the anchoring bolts which attach the structural connections have a tendency to travel with the grain of wood and eventually tear loose from the beam.

Thus, it is one object of this invention to provide an apparatus which will join two beams in perpendicular configuration.

It is a further object of this invention to provide an apparatus which will resist the migration of an anchor bolt parallel to the grain of wood when a force is applied longitudinally on the beam.

It is yet another object of this invention to provide an apparatus which reacts to longitudinal forces by compressing the grains of wood and increasing the resistance to migration of an anchor bolt parallel to the wood grain.

DISCLOSURE OF THE INVENTION

This invention provides apparatus for securing a beam to a structure which comprises means for pivotally attaching one end of a link means to the structure, means for pivotally attaching the other end of the link means to the beam at a point distal from the structure and means for supplying a compressing force to the beam intermediate the ends of the link means, the compressing force responsive to relative motion between the beam and the structure.

BEST MODE FOR CARRYING OUT THE INVENTION

Figure 1:
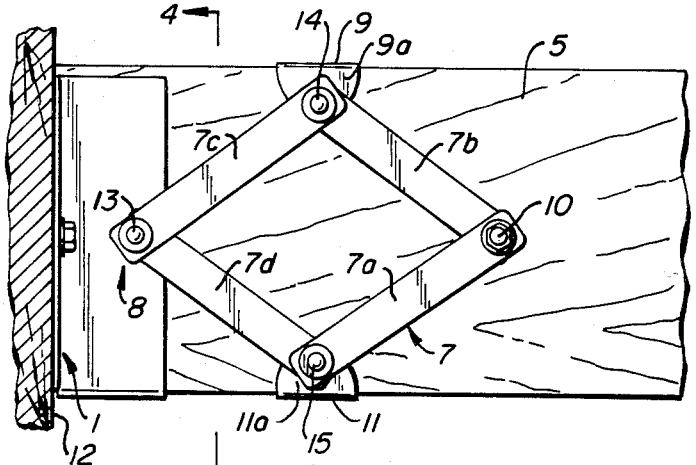
FIG. 1 is a side view, with portions broken away, of the apparatus as attached to a beam.

This invention provides an apparatus for joining beams perpendicularly to a structure such that a force applied longitudinally to the beam will tend to compress the grain of that beam and resist dislocation of the anchoring point. The apparatus will be described in detail by reference to the drawings.

In the figures it is seen that the apparatus is connected to the face of a structure 12, which can be another beam or standing wall, by means of a bracket 1 which has a "U" shaped channel section 2 and flanges 3 and 4 for fastening to the structure 12. This "U" shaped channel in the bracket provides a space for accepting a wooden beam 5 and retaining it in perpendicular orientation to the structure 12. However, it can be seen that this configuration is not essential to the invention but is merely envisioned as a means of simplifying construction and providing additional support to vertical loads on the beam 5. This bracket 1 could be replaced by a pair of brackets on either side of the beam 5 or by anchor bolts inserted directly into the face of the structure 12.

Figure 2:
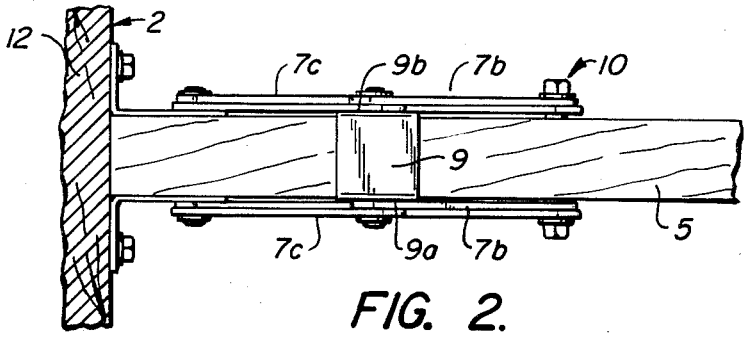
FIG. 2 is a plan view, with portions broken away, of the apparatus showing the paired configuration of the link means and the anchoring attachment through the beam.

Located at a predetermined distance from the structure 12 is an anchor bolt 10 which extends through the beam 5 to provide a pivot point for one end of each of a pair of linking devices 7 located on opposite sides of the beam 5. This anchor bolt 10 and its connection to the linking devices 7 may be more clearly seen in FIG. 2. This anchor bolt 10 is the only part of the apparatus which actually penetrates the surface of the beam 5.

Intermediate the bracket 1 and the anchor bolt 10, are the four links *7a, 7b, 7c* and *7d* arranged in a rhomboid configuration, which make up each linking device 7. However, while a rhomboid configuration is considered advantageous to distribute the forces evenly, a quadralateral configuration having nonparallel sides could be established and remain within the scope of the invention.

The links *7a, 7b, 7c* and *7d* of the linking device 7 are interconnected in a pivotal manner so that the angles subtended by the links can change by extension or compression along either axis. This pivotal fastening can be done by pins, rivets, bolts or any other means known to the art which allows the angles of the links to remain adjustable.

Thus, the ends of the links *7a* and *7b* which are furthest from the wall 12 are pivotally connected together and to the beam 5 by the bolt 10. The end of the link *7c* located furthest from the wall 12 is pivotally joined together at pivot point 14 with the other end of link *7b* to a downwardly extending flange *9a* or *9b* of a top compression plate 9 which extends over the top of the beam 5. The end of the link *7d* located furthest from the wall 12 is pivotally joined together at pivot point 15 with the other end of link *7a* to an upwardly extending flange 11*a* or 11*b* (not shown) of a bottom compression plate 11. The other ends of the links *7c* and *7d* are pivotally joined together with each flange 8 at pivot point 13. It will be understood that this arrangement is duplicated on the other side of the beam from the side shown in FIG. 2.

In practice, the pivot points 10 and 13 are preferably located along a line which is parallel to the longitudinal axis of the beam 5 and the pivot points 14 and 15 are located on a line which is perpendicular to the longitudinal axis of the beam 5.

Figure 3:
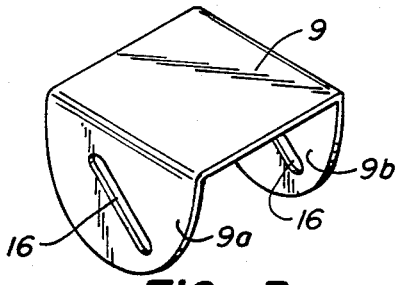
FIG. 3 is a perspective view showing one of the compression plates together with its flanges and one cam surface.
Figure 4:
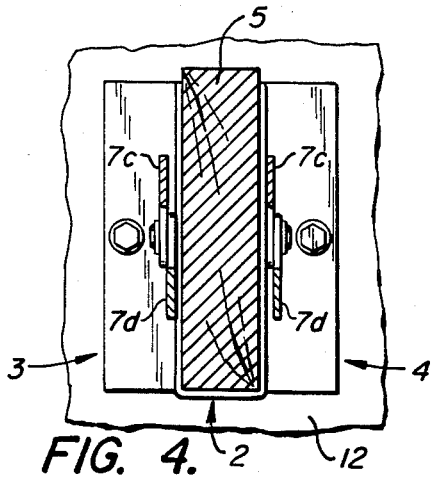
FIG. 4 is a vertical, sectional view taken generally along the lines 4—4 in FIG. 1.

In FIG. 3, the compression plate 9 (or 11) and its flanges 9*a* and 9*b* (or 11*a* and 11*b*) are shown with a cam surface 16 which is cut into the flanges. This cam surface is shown as a slot 16 which slants toward the center line of the wooden beam as it proceeds toward the anchor bolt 10. The slot is preferably cut with an angle of approximately 30° from the longitudinal axis of the beam 5.

The pivotal attachment of the links *7b* and *7c* (or *7a* and *7d*) slides in this slot when the top plate 9 is moved with respect to the bottom plate 11. In this manner, the intermediate pivot point 14 (or 15) will bear against the cam surface 16 and inward motion of the compression plates 9 and 11 will not loosen the fit of the apparatus.

With the foregoing specific description, the operation of this invention will now be explained.

A wooden beam 5, which is typically of standard size in building construction, is inserted into the apparatus so that it establishes a perpendicular orientation with a standing wall or beam 12 to which the apparatus is affixed. The wooden beam 5 can rest in the space defined by bracket 1 and be vertically supported by the seat 2 of the "U" shaped configuration.

A hole is then bored through the wooden beam 5 and the anchor bolt 10 inserted through the ends of the links *7a* and *7b* on one side of the beam 5, through the wooden beam 5, and through the ends of the links *7a* and *7b* on the opposite side of the wooden beam 5. The distance from the wall 12 which this hole is bored is chosen so that the compression plates 9 and 11 are a snug fit on the top and bottom of the wooden beam.

As the wood in the beam dries further it is expected to contract along lines 4—4. This would ordinarily cause a loosening of the fit of the compression plates 9 and 11.

If the apparatus has been constructed with the above mentioned cam surface 16, this slight contraction will be compensated during the inward motion of the compression plates 9 and 11 by the movement of the intermediate pivot point 14 in the slot. Thus, during the course of ordinary and expected curing of the wood, the device will actually be made to fit as snugly and to retain the wooden beam 5 and the standing wall 12 in their nearly original positions.

In the event of an adverse force, such as an earthquake, applied longitudinally to the wooden beam 5 which tends to separate it from the standing wall 12, this force will be translated by the link mechanism 7 into increased compression by the inward motion of the compression plates. Thus an increased density of wood grain in the wooden beam 5 between these compression plates 9 and 11 is obtained. In this manner, the anchor bolt 10 meets with greater resistance and a greater amount of force is required to cause the anchor bolt to tear through the wood parallel to the wood grain.

The ordinary strength of the materials in the wood beam is thus increased during adverse environmental forces, thereby preserving the structural integrity of the orientation of the beam.

While in the above described embodiments the link mechanism 7 and plates 9 and 11 have been shown with a particular orientation with respect to the vertical, it should be apparent that the entire fastening assembly can, in other embodiments, be rotated 90° about the longitudinal axis of the beam 5 without derogating the invention. Also, while in the preferred embodiment all of the pivot points 13, 14, 15 and the bolt 10 are illustrated in the standard fashion, i.e. with a pivot pin, in less advantageous embodiments these points can be reinforced, solid connections which ordinarily would not pivot but which would act as pivots if a sufficient bending force is applied. These might be thought of as inelastically yieldable pivot points which would deform under the stress of an earthquake load in the same manner as a conventional pivot. Also, while the beam 5 is depicted as having a rectangular cross-section, the apparatus of the invention is obviously suitable for any sort of beam, provided the compression plates 9 and 11 are appropriately configured to mate with the beam's outer shape.

Although the foregoing invention has been described in some detail by way of illustration and example for purposes of clarity of understanding, it will be obvious to those skilled in the art that certain changes and modifications may be practiced within the scope of the appended claims.

We claim:

1. Apparatus for securing one end of a beam to a structure, the securing apparatus comprising:

(a) two ended link means, (b) first means for pivotably attaching one end of the link means to the beam at a point distal from the structure, (c) second means for pivotably attaching the other end of the link means to the structure, and (d) wherein the link means includes compression means intermediate its ends for supplying a compressing force to the beam across its width at a point intermediate the pivotal attachments when the distance between the pivotal attachments is increased due to relative motion between the beam and the structure.

2. Beam securing apparatus as recited in claim 1 wherein the first and second means provide pivotal attachments along a line which is parallel to the longitudinal axis of the beam.

3. Beam securing apparatus as recited in claim 2 wherein the link means comprises a pair of four link sets located on opposite sides of the beam, and the pivot means comprises yieldable pivot point connections between the end of each of the links and the ends of the two nearest links.

4. Beam securing apparatus as recited in claim 3, wherein the compression means comprises opposed plates having flanges projecting perpendicular to the plates which form intermediate pivot points for the links.

5. Beam securing apparatus as recited in claim 1, 2, 3 or 4 wherein the second pivot means further comprises a bracket having a channel section providing a space for accepting the beam.

6. Beam securing apparatus as recited in claim 4, wherein the flanges on at least one compression plate each further comprise a cam surface which adjusts the intermediate pivot point for the links when the distance between the compression plates is decreased due to relative motion between the top and bottom of the beam.

* * * * *